US007802388B2

(12) United States Patent
Henkel et al.

(10) Patent No.: US 7,802,388 B2
(45) Date of Patent: Sep. 28, 2010

(54) LAMINATING LABELS

(75) Inventors: Alex Henkel, Walpole, NH (US); Jason Wilder, Troy, NH (US); Juan Munoz, Troy, NH (US)

(73) Assignee: Electronic Imaging Materials, Inc., Keene, NH (US)

( * ) Notice: Subject to any disclaimer, the term of this patent is extended or adjusted under 35 U.S.C. 154(b) by 0 days.

(21) Appl. No.: 12/098,848

(22) Filed: Apr. 7, 2008

(65) Prior Publication Data

US 2009/0249670 A1 Oct. 8, 2009

(51) Int. Cl.
*G09F 3/10* (2006.01)

(52) U.S. Cl. ..... 40/638; 428/40.1

(58) Field of Classification Search ..... 40/638; 428/40.1, 41.8, 42.2, 42.3
See application file for complete search history.

(56) References Cited

U.S. PATENT DOCUMENTS

| | | | | | |
|---|---|---|---|---|---|
| 2,095,437 | A | * | 10/1937 | Fox | 40/638 |
| 2,767,495 | A | * | 10/1956 | Harris | 40/638 |
| 3,077,683 | A | * | 2/1963 | Jones | 40/638 |
| 3,148,468 | A | | 9/1964 | Vander Weel et al. | |
| 3,153,868 | A | * | 10/1964 | Jones | 40/638 |
| 4,061,808 | A | | 12/1977 | Sato | |
| 4,068,028 | A | | 1/1978 | Samonides | |
| 4,159,586 | A | | 7/1979 | Blum | |
| 4,199,645 | A | | 4/1980 | Schwarz | |
| 4,248,919 | A | | 2/1981 | Davis | |
| 4,393,107 | A | | 7/1983 | Jenkins | |
| 4,446,183 | A | | 5/1984 | Savagian | |
| 4,521,267 | A | | 6/1985 | Jacobson | |
| 4,696,843 | A | | 9/1987 | Schmidt | |
| 4,823,783 | A | | 4/1989 | Willhite, Jr. et al. | |
| 4,869,941 | A | | 9/1989 | Ohki | |
| 4,951,970 | A | | 8/1990 | Burt | |
| 4,959,115 | A | | 9/1990 | Lacy | |
| 5,019,436 | A | | 5/1991 | Schramer et al. | |
| 5,093,168 | A | | 3/1992 | Suzuki et al. | |
| 5,103,583 | A | | 4/1992 | VanErmen | |
| 5,201,976 | A | | 4/1993 | Eastin | |

(Continued)

OTHER PUBLICATIONS

Electronic Imaging Materials, Inc.: Quotation Number: 85407 issued on Aug. 6, 2002 including the CytoLabel™ with laminate shield.

(Continued)

*Primary Examiner*—Lesley Morris
*Assistant Examiner*—Kristina Staley
(74) *Attorney, Agent, or Firm*—Grossman, Tucker, Perreault & Pleger, PLLC

(57) ABSTRACT

A label including a lamination, a method of using such label and a method of making such label. The label may include a liner, a face stock having a first surface and a second surface opposite the first surface, disposed over a portion of the liner. In addition, the label may include a laminating material having a first surface and a second surface opposite the first surface and a first edge and a second edge, wherein the laminating material is disposed over a portion of the liner and the second surface is proximate to said liner. Furthermore, the label may include at least two creases in the liner upon which the liner may be folded to locate the second surface of the laminating material over the first surface of the face stock.

20 Claims, 8 Drawing Sheets

U.S. PATENT DOCUMENTS

| | | | | |
|---|---|---|---|---|
| 5,230,938 | A | 7/1993 | Hess et al. | |
| 5,238,272 | A | 8/1993 | Taylor | |
| 5,240,755 | A | 8/1993 | Zimmer | |
| 5,262,214 | A | 11/1993 | Instance | |
| 5,262,216 | A | 11/1993 | Popat et al. | |
| 5,264,265 | A | 11/1993 | Kaufmann | |
| 5,268,228 | A | 12/1993 | Orr | |
| 5,275,868 | A | 1/1994 | Popat et al. | |
| 5,279,690 | A | 1/1994 | Hess, Jr. et al. | |
| 5,279,875 | A | 1/1994 | Juszak et al. | |
| 5,283,093 | A | 2/1994 | All | |
| 5,284,688 | A | 2/1994 | Hiatt | |
| 5,290,616 | A | 3/1994 | Cowan et al. | |
| 5,376,418 | A | 12/1994 | Rogers et al. | |
| 7,055,273 | B2 * | 6/2006 | Roshkoff | 40/638 |
| 2003/0051383 | A1 * | 3/2003 | Attia et al. | 40/641 |

OTHER PUBLICATIONS

Electronic Imaging Materials, Inc.: Quotation Number: 85155 issued on Sep. 12, 2002 including the CytoLabel™ with laminate shield.

Electronic Imaging Materials, Inc.: Quotation Number: 84994 issued on Oct. 7, 2002 directed to the CytoLabel™ with the matching clear laminate.

Electronic Imaging Materials, Inc.: Letter Dated Jun. 18, 2001 to Mike regarding CytoLabel™.

Electronic Imaging Materials, Inc.: Letter Dated Jun. 20, 2001 to Sharlyn regarding CytoLabel™ including samples. The samples are illustrated in the Drawings of the Label included herein.

Electronic Imaging Materials, Inc.: Letter Dated Aug. 23, 2001 to Mary regarding CytoLabel™.

Electronic Imaging Materials, Inc.: Letter Dated Jan. 30, 2002 to Nasier regarding CytoLabel™ including samples. The samples are illustrated in the Drawings of the Label included herein. (2 pgs).

Electronic Imaging Materials, Inc.: Letter Dated Feb. 8, 2002 to Emily regarding CytoLabel™ including samples. The samples are illustrated in the Drawings of the Label included herein.

Electronic Imaging Materials, Inc.: Letter Dated Mar. 31, 2003 to Chris regarding CytoLabel™ including samples. The samples are illustrated in the Drawings of the Label included herein.

Electronic Imaging Materials, Inc.: Letter Dated Mar. 10, 2004 to Cyrill regarding CytoLabel™ including samples. The samples are illustrated in the Drawings of the Label included herein.

EIMINC Laboratory Applications Presentation Dated Jun. 3, 2004 including discussion of CytoLabel™ . (13 pgs).

Drawings of the Label including FIG. 1 is a top plan view of the die cut labels; and FIG. 2 is a schematic end view of the construction of FIG. 1. No publication date. (2 sheets).

* cited by examiner

LAMINATING LABELS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

FIELD OF THE INVENTION

The present disclosure relates to labels including a lamination and, in particular, labels including a lamination that may be self-registering over the face stock of the label.

BACKGROUND

Labels may be used in a number of applications for identification purposes. In a number of these applications, labels may be exposed to relatively high degrees of wear, sun exposure, weather exposure, chemical exposure, exposure to gasses or fluids, and/or other types of exposure. Examples may include library environments, where labels may be exposed to scuffing; clinical or laboratory environments, where the labels may be exposed to various chemicals or fluids; as well as packaging or shipping labels, where the labels may be exposed to the weather. To protect the labels, laminating materials may be provided over the labels.

Some consumers turn to label service bureaus to pre-print labels that may be exposed to the elements described above. The labels may be prepared, printed and then provided with a laminate over the label by a third party, who then ships the prepared label to the consumer. Service bureaus may accommodate applications where labels are consecutively numbered, such as for providing product serial numbers or bar code labels, as well as applications where large quantities of labels may be desirable. However, in some applications, it may be desirable to immediately obtain a label, either customized or including standard graphic content, which may be laminated, without waiting for a label to be produced by and received from a third party.

SUMMARY OF THE INVENTION

An aspect of the present disclosure relates to a label. The label may include a liner, a face stock having a first surface and a second surface opposite the first surface disposed over at least a portion of the liner, wherein the second surface is proximate to the liner. The label may also include a laminating material having a first surface and a second surface opposite the first surface and a first edge and a second edge, wherein the laminating material is disposed over at least a portion of the liner and the second surface is proximate to the liner. Furthermore, the label may include at least two creases in the liner upon which the liner may be folded to locate the second surface of the laminating material over the first surface of the face stock, wherein one of the creases is positioned between the first and second edges of the laminating material.

Another aspect of the present disclosure relates to a method of forming a label including a laminating layer. The method may include providing a liner, disposing a face stock over a portion of the liner, wherein the face stock has a first surface and a second surface, and the second surface is proximate to the liner. The method may also include disposing a laminating material over a portion of the liner, wherein the laminating material has a first surface and a second surface and a first edge and a second edge, and the laminating material is disposed over the liner, and the second surface is proximate to the liner. Furthermore, the method may include providing at least two creases in the liner upon which the liner may be folded to locate the second surface of the laminating material over the first surface of the face stock, wherein one of the creases is positioned between the first and second edges of the laminating material.

A further aspect of the present disclosure relates to a method of laminating labels. The method may include providing a label comprising a liner, a face stock having a first surface and a second surface opposite the first surface disposed over at least a portion of the liner, wherein the second surface is proximate to the liner, a laminating material having a first surface and a second surface opposite the first surface and a first edge and a second edge, wherein the laminating material is disposed over at least a portion of the liner, and the second surface is proximate to the liner, and at least two creases in the liner. The method may also include folding the liner at the creases to locate the second surface of the laminating material over the first surface of the face stock, wherein one of the creases is positioned between the first and second edges of the laminating material.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
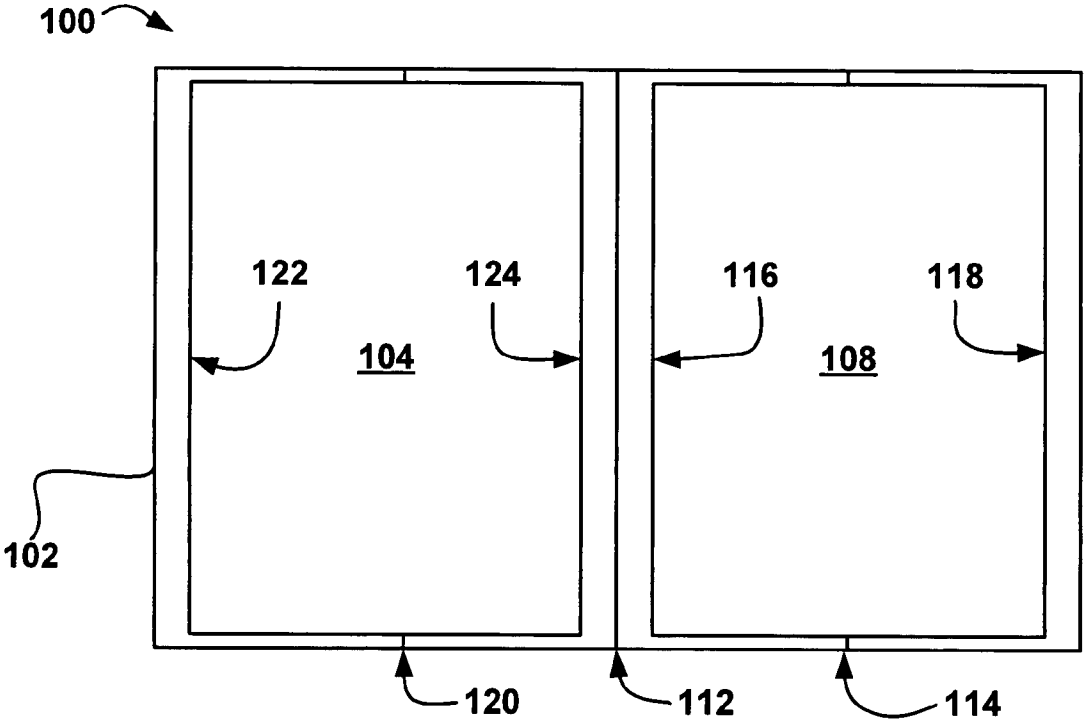
FIG. 1 is a top plan view of an example of a label construction contemplated herein.

It is to be understood that this disclosure is not limited in its application to the details of construction and the arrangement of components set forth in the following description or illustrated in the drawings. The embodiments herein are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "disposed," and "mounted," and variations thereof herein are used broadly and encompass direct and indirect contact and/or mountings.

The present disclosure relates to labels including a lamination for covering and/or protecting the labels, a process for making such labels and a process for using such labels. Prior to application, the labels may be printed on by an image forming device. The labels may be individualized, including unique graphics, or the labels may include similar graphic content, wherein graphics may be understood as images, text or other characters. The labels may be prepared and/or printed individually or in batches. To apply the labels, an individual label may be partially adhered to a surface and the laminate may be positioned over the label and partially adhered. Once the laminate is positioned, the label may be completely adhered to the surface and the laminate may be fully adhered to the label.

Figure 2:
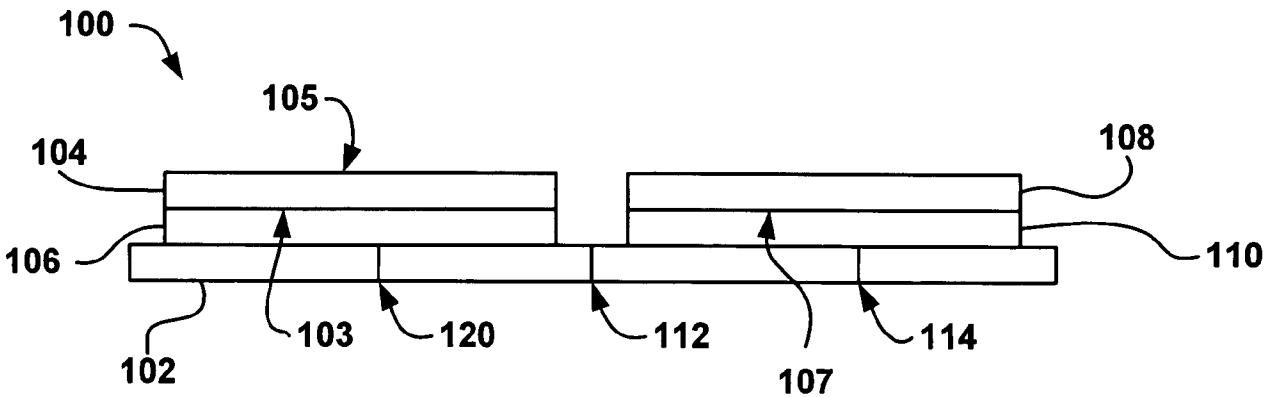
FIG. 2 is a side view of the label construction of FIG. 1.

FIGS. 1 and 2 illustrate a top plan view and side view, respectively, of an example of a label construction, prior to the face stock and/or laminating material being die-cut. The label 100 may include a liner 102 and a face stock 104, disposed over a portion of the liner 102. The face stock 104 may be disposed either directly or indirectly over the liner 102. A first adhesive 106 may be disposed between at least a portion of the liner 102 and a surface 103 of the face stock 104. The label 100 may also include a laminating material 108 disposed either directly or indirectly over another portion of the liner 102. A second adhesive 110 may be disposed between at least a portion of the liner 102 and a surface 107 of the laminating material 108.

The liner 102 may include paper or a film, including polymeric films. The liner may also be coated with a release coat, such as silicone, which may aid in removing the liner from the adhesive layer. In addition, the liner may include a number of creases and/or slits. In one example, as illustrated in FIGS. 1 and 2, the liner may include at least two creases 112 and 114. The creases may be formed in the liner by perforations or scores in the liner. The perforations and/or scores may be formed during the liner forming process or may be formed by, for example, die cutting or pressing the liner. It may be appreciated that the liner may remain relatively flat after the creases have been imparted to the liner until the liner is otherwise bent, such as during the process of providing the label on a substrate.

Figure 3:
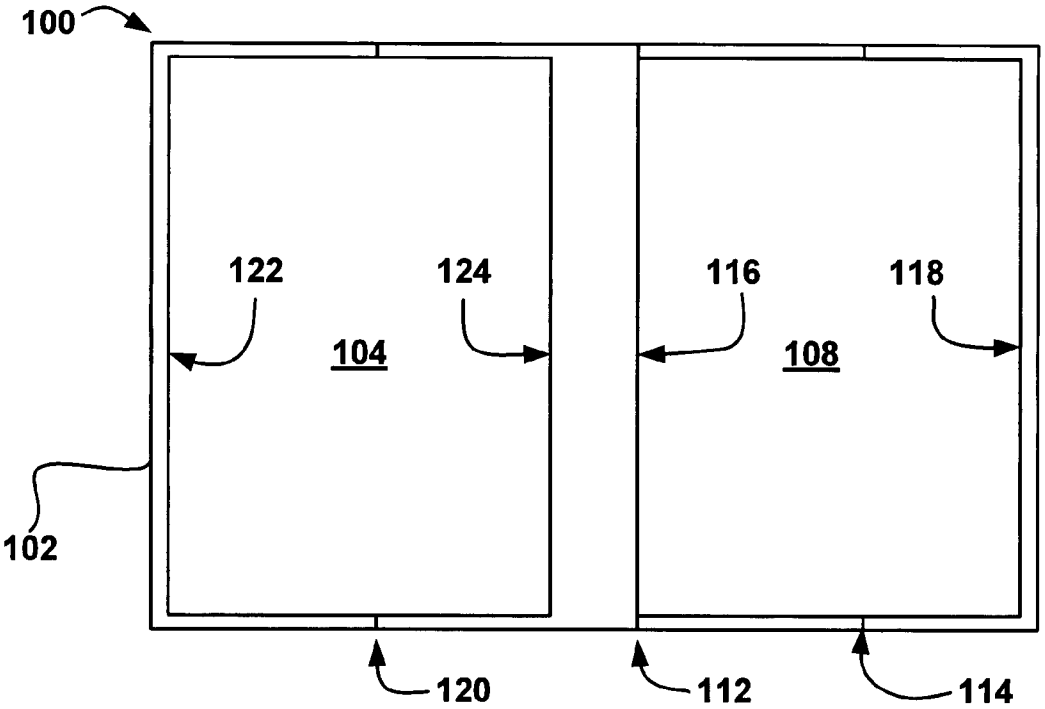
FIG. 3 is a top plan view of another example of a label construction contemplated herein.
Figure 4:
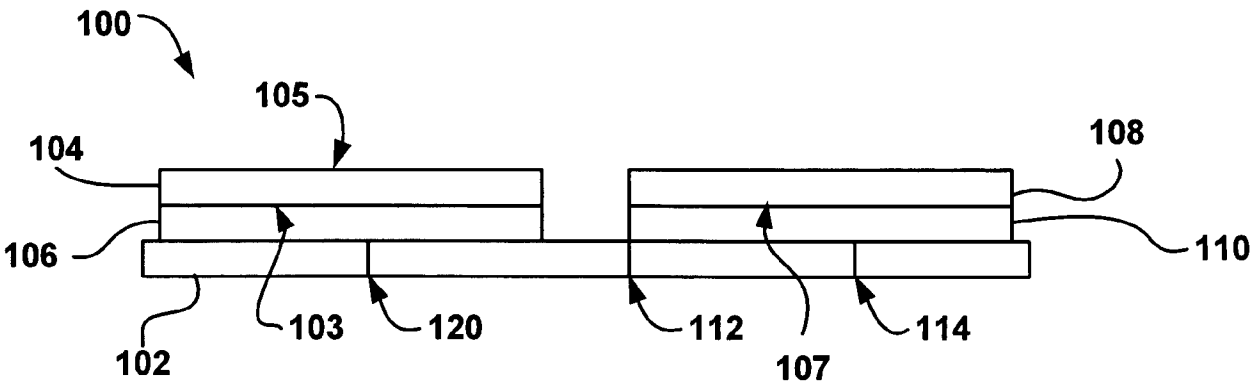
FIG. 4 is a side view of the label construction of FIG. 3.

At least one of the creases, such as crease 114 may be positioned between a first edge 116 and a second edge 118 of the laminating material. Another one of the creases, such as crease 112, may be positioned between the face stock 102 and the laminating material 108. In another example, illustrated in FIGS. 3 and 4, a crease 114 may be positioned between the first edge 116 and the second edge 118 of the laminating material 108 and a second crease 112 may be positioned contiguous with the first edge 116 of the laminated material 108. It may be appreciated that the creases 112 and 114 may be positioned in various other locations to position the laminated material 108 relative to the face stock 104.

The liner 102 may also include one or more slits, perforations or score lines 120 down the length of the liner. The additional slit, perforation or score line may be positioned, for example, between a first edge 122 and a second edge 124 of the face stock 104. A slit may allow for a portion of the liner to be removed, such that, at least a portion of adhesive on the bottom surface of the face stock may be positioned over and adhered to a substrate surface. Where perforations are contemplated, the liner may be torn or bent at the perforation mark and where one or more score lines are contemplated, the liner may be folded at the score line and the face stock may be at least partially positioned or adhered onto a substrate surface. The liner may be in the range of 1 μm to 250 μm in thickness, including all values and increments therein.

A first adhesive 106 may be provided between at least a portion of the face stock 104 and the liner 102. In addition, a second adhesive 110 may be provided between at least a portion of the laminating material 108 and the liner 102. The first and second adhesives may be the same or different materials. The adhesives may be pressure sensitive adhesives, which may be applied dispersed in a solvent. The adhesives may include one or more chemical components, which may be combined prior to the application of the adhesives to the face stock, liner or laminating material. The adhesives may include, for example, urethanes, epoxies, acrylics or rubber based materials. In one example, the adhesives may be capable of withstanding temperatures, i.e., retaining a portion of its tackiness or flexibility, in the range of −240° C. to 205° C., including all values and increments therein, such as in the ranges of −240° C. to 100° C., −160° C. to 79° C., −100° C. to 150° C., etc., depending on the temperature requirements of the label.

It may be appreciated that the adhesives may be disposed on either the liner, the face stock or the laminating material and located around the edges of the face stock or laminating material, in the center of the face stock or laminating material, or in patterns within the boarders of the face stock or laminating material. The adhesives may be coated or printed on the liner, face stock or laminating material by a number of printing methods, including flexographic techniques, gravure techniques, etc. In addition, the adhesives may be applied at a thickness in the range of 0.1 μm to 250 μm, including all values and increments therein.

The face stock 104 may be formed from a film or sheet, which may include thermoplastic material, paper, or fabric including thermoplastic material and/or natural material, etc. Thermoplastic material may include polyethylene, polypropylene, polyester, vinyl, acetate, polystyrene, or combinations thereof. Natural material may include wool, cotton, cellulose based materials, or combinations thereof. The face stock may be in the range of 1 μm to 250 μm in thickness, including all values and increments therein.

In one example, at least 50% of incident light in the visible range, i.e., in the range of 350 to 780 nm, including all values and increments therein, may pass through the face stock. Incident light may be understood as direct light that falls on a surface. In another example, the face stock may be any color, reflecting a portion of incident light in the visible range corresponding to, for example, red, orange, green, blue, indigo, purple and/or various shades, hues, tints and combinations thereof. While, the face stock herein may be white, i.e., reflecting substantially all, or at least 90% of incident light in the visible spectrum, including all values and increments in the range of 90% to 99.9%, it may be appreciated that the face stock herein need not be white and in some examples are not white. Furthermore, the face stock herein may be black in color, absorbing a relatively significant portion of light, such as greater than 90% of incident light in the visible spectrum, including all values and increments in the range of 90% to 99.9%. In addition, the face stock may be combinations of various colors, including black and/or white, and include portions through which varying degrees of light may pass.

Figure 5:
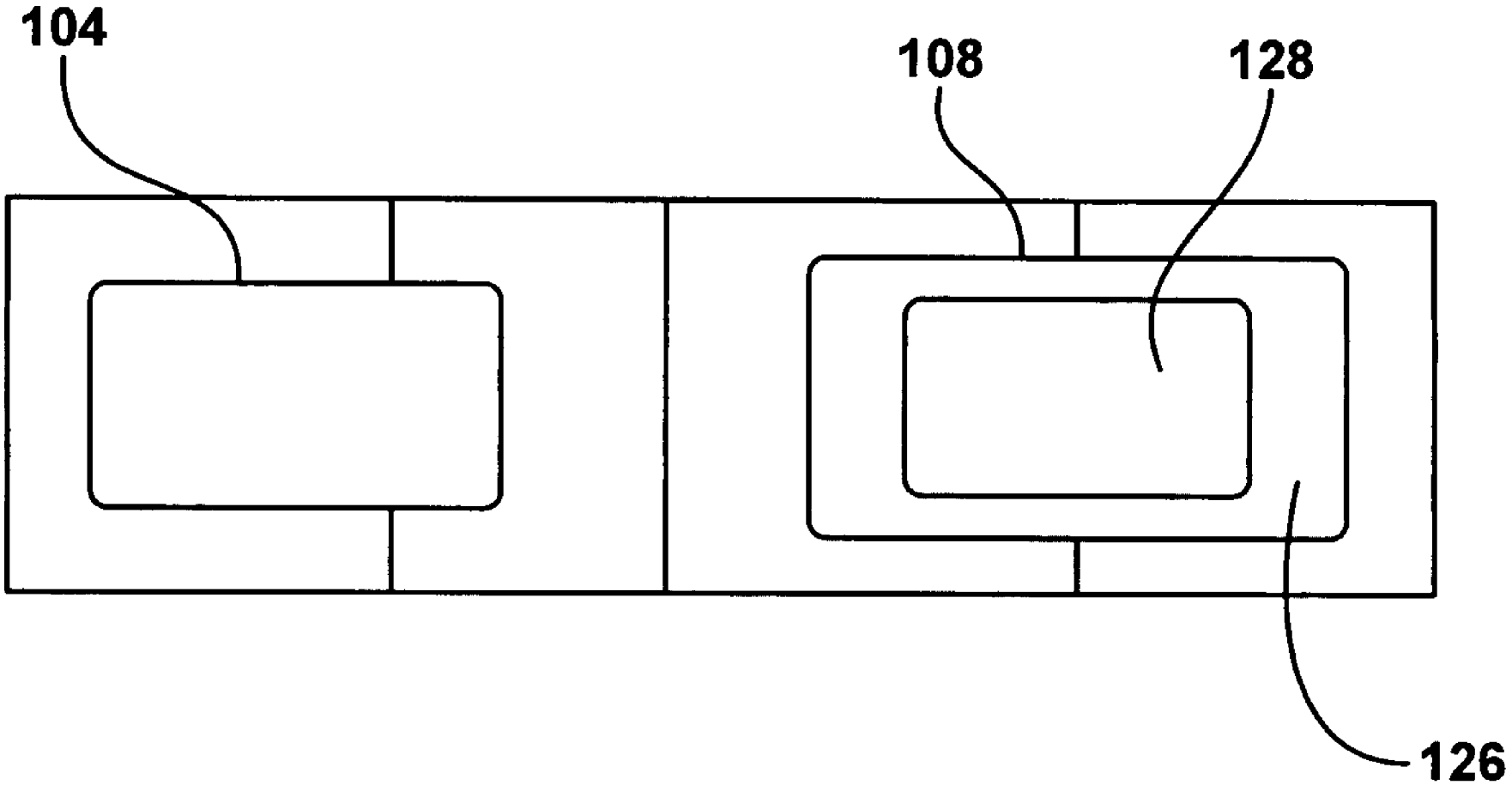
FIG. 5 is a top plan view of another example of a label construction contemplated herein.

The laminating material 108 may include a film, such as a polymeric or thermoplastic film. The laminating material may include, for example, polyesters, a polyolefin such a polypropylene or polyethylene, polyvinylchloride, or combinations thereof. The laminating material may also include multiple layers, which may impart moisture, vapor or gas barrier properties. The laminating material may be in the range of 1 μm to 250 μm in thickness, including all values and increments therein. In one example, such as illustrated in FIG. 5, the laminating material 108 may have a surface area $SA_1$ and/or define a perimeter that may be slight larger than the surface area $SA_2$ and/or perimeter of the face stock 104, wherein $SA_1 > SA_2$. Where the laminating material may be larger than the face stock, the laminating material may provide a seal around the face stock, preventing exposure of the face stock to fluids or gasses, depending on the chemical composition of the laminating material.

The laminating material may include a relatively opaque or relatively translucent coating over at least a portion of the laminating material. For example, as illustrated in FIG. 5, an opaque coating 126 may be provided around the edges of the laminating material, providing a "window" 128 for viewing the face stock 104, when the laminating material 108 is positioned over the face stock 104. In another example, a removable opaque or relatively translucent coating may be applied to the laminating material, which may hide the contents of the label provided on the face stock. The coating may be removed, for example, by scratching the coating off, or by peeling the coating from the laminating material.

A relatively opaque coating may be understood as a coating that may absorb, reflect or otherwise block 50% or more of incident light, including all values and increments in the range of 50% to 100%. A relatively translucent coating may be understood as a coating wherein a portion of incident light, in the range of 5% to 99%, including all values and increments therein, may pass through the coating, but the image may be cloudy or distorted due to diffusion of the light through the coating. It may be appreciated that rather than coatings, the opacity and/or translucency may be provided within the laminating material itself, due to variation in materials, process parameters, surface finishing, etc.

The face stock and/or laminating material may be provided in any number of geometries. For example, the face stock and/or laminating material may include rounded corners 130, as illustrated in FIG. 5. However, it may be appreciated that the face stock and laminating material may include other geometries, such as circular geometries, triangular geometries, square geometries, or take the form of various characters, text or numbers.

Figure 6:
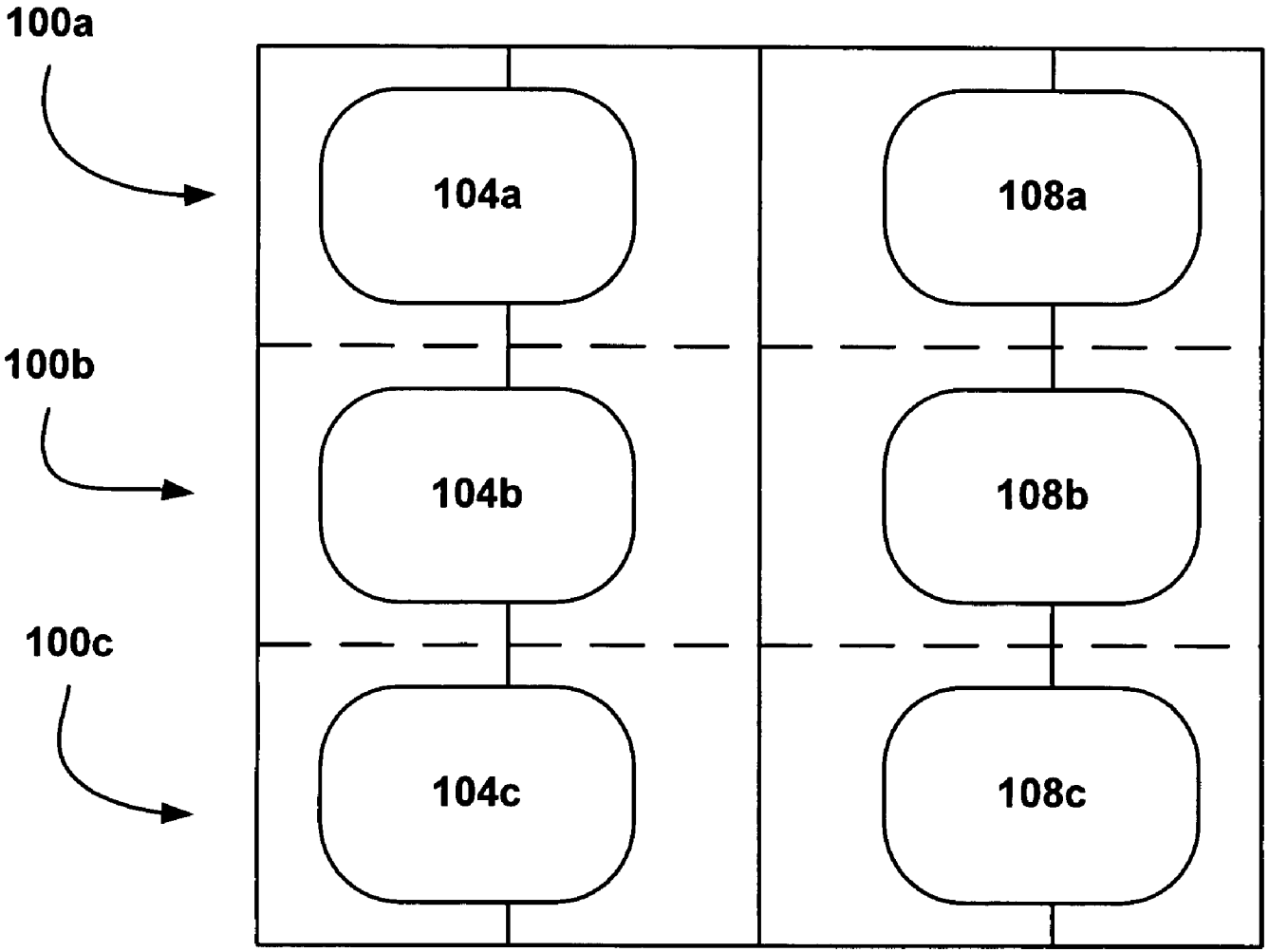
FIG. 6 is a top plan view of yet another example of a label construction contemplated herein.

Individual labels may be provided on a single liner as illustrated in FIG. 5 or, as illustrated in FIG. 6, a number of labels 100*a*, 100*b*, 100*c*, including face stock 104*a, b* and *c* and laminating material 108 *a, b* and *c* may be provided on a single liner 102. Perforations 132 and 134 may be provided between the individual labels 100*a*, 100*b*, 100*c*, such that before or after printing, the labels may be separated and individually placed on a given substrate. It may also be appreciated that the face stock and laminating material may be oriented in different directions. For example, as generally illustrated the face stock and laminating material are oriented side by side; however up and down orientations, wherein the label may be turned approximately 90 degrees in either direction, or diagonal orientations may be utilized as well, depending on the application of the label. Where the liner may include a number of labels, the liner may be provided in the form of strips or sheets, which may be rolled or stacked.

Figure 7:
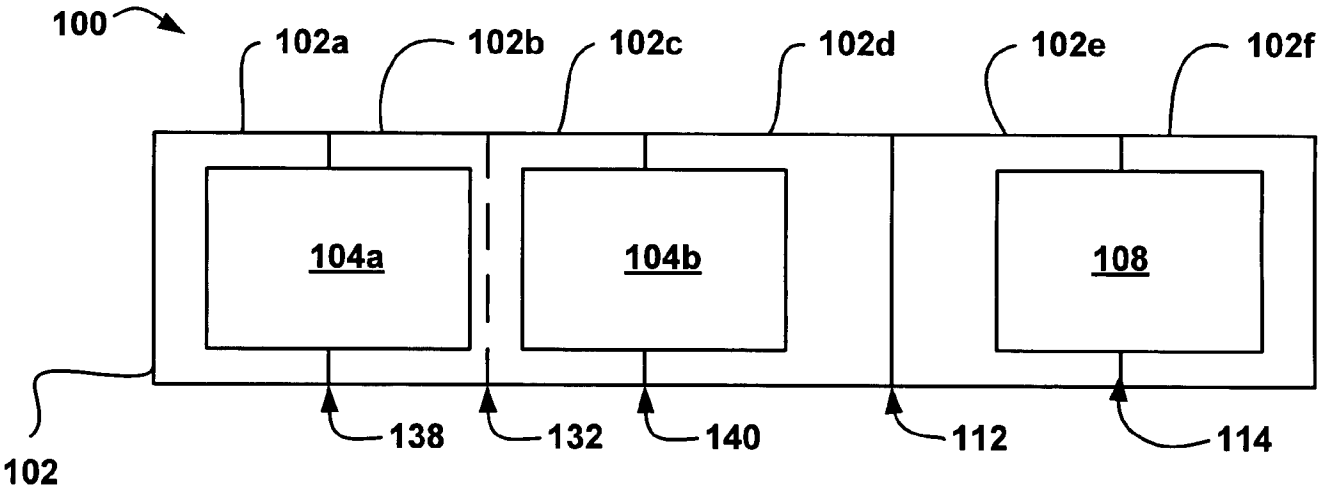
FIG. 7 is a top plan view of another example of a label construction contemplated herein.
Figure 8:
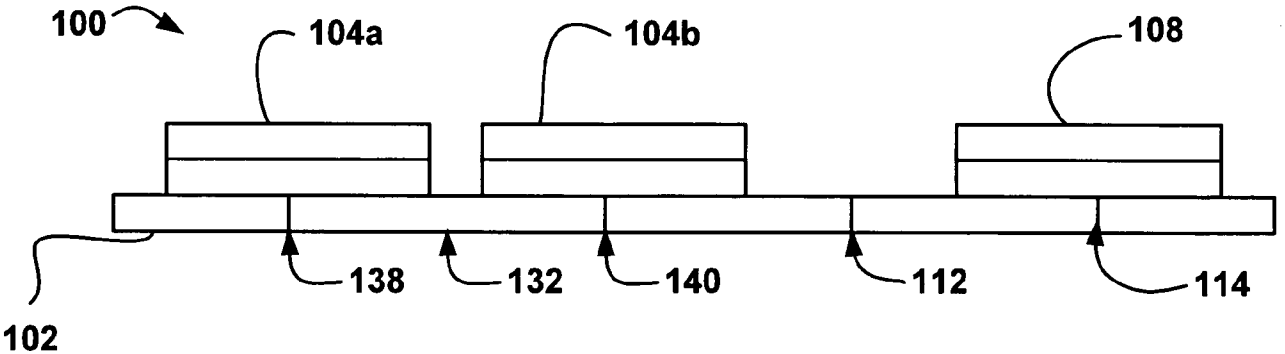
FIG. 8 is a side view of the label construction of FIG. 7.

As alluded to above, more than one label, i.e., including face stock and an adhesive, may be provided on the liner, and additional slits and/or additional perforations may be added to facilitate in the removal or adhesion of the labels to a surface. FIGS. 7 and 8, illustrate an example where two pieces of face stock 104*a* and 104*b* may be provided on a liner 102. The first piece of face stock 104*a* may be separated from the second piece of face stock 104*b*, either by peeling the face stock from the liner or by tearing the liner along a perforation 136, and applied to a first surface. The second piece of face stock 104*b*, or a portion thereof may then be positioned and applied to a second surface, and laminated. The liner 102 may include a number of slits 138 and 140 to facilitate placement of the pieces of face stock 104*a* and 104*b* on the respective surfaces. In addition, the various creases 112 and 114 for locating the laminating material 108 with respect to the face stock 104*b* may be present.

Figure 9:
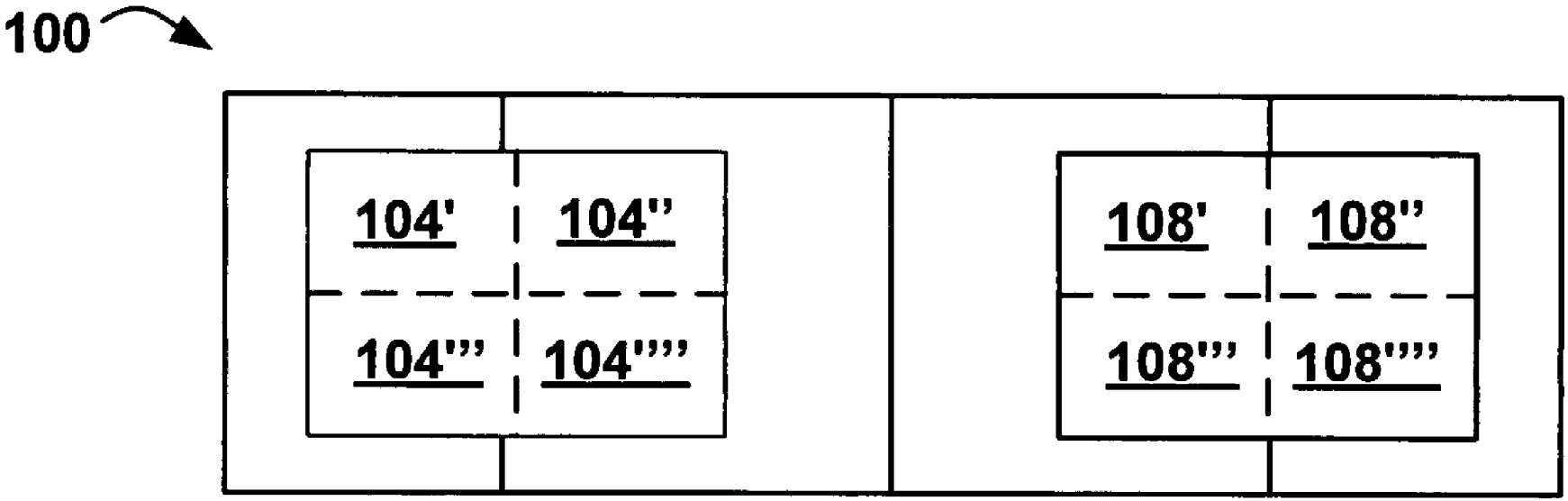
FIG. 9 is a top plan view of yet another example of a label construction contemplated herein.

FIG. 9 illustrates another example of a label construction, wherein a label 100 may be separated into a number of partitions, 104', 104", 104''', 104''''. In addition, the laminate 108', 108", 108''', 108'''' may be partition-able as well. The partitions may be formed by perforations or slits provided in the face stock 104 and laminate 108. The perforations or slits may be formed by a number of methods, such as die-cutting, laser cutting, etc. The various partitions may include or be printed with graphic content including cross-reference information in each partition. It may be appreciated that various other label constructions and/or arrangements may be provided as well.

Prior to adhering the label to a substrate surface, a surface of the face stock may be provided with graphics by an image forming device. Image forming devices may include electrophotographic printers, thermal printers, inkjet printers, copiers, multi-functional devices, etc. Individual labels or a batch of labels may be printed at a given time. In addition, the labels may include the same, or different graphics content. In one example, (referring to FIG. 2) the upper surface 105 of the face stock 104 may be provided with graphics; however, it may be appreciated that the lower surface 103 of the face stock 104 may be provided with graphics as well.

Figure 10A:
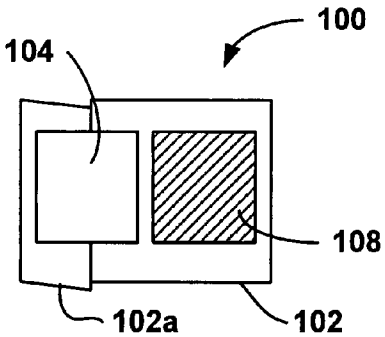
FIGS. 10*a* through 10*e* are an illustration of an example of providing and laminating a label.
Figure 10B:
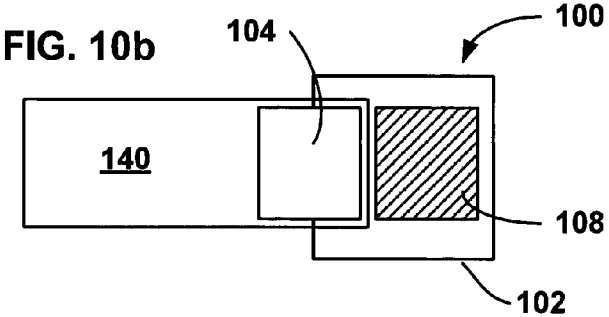
Figure 10C:
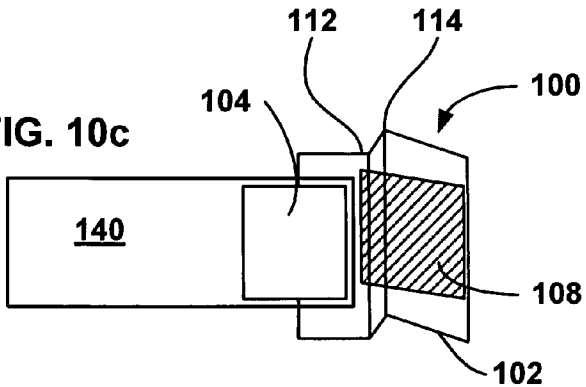
Figure 10D:
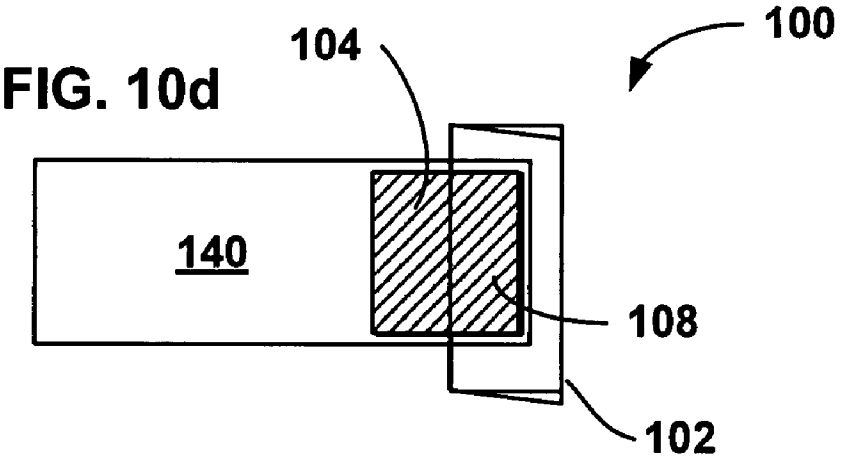
Figure 10E:
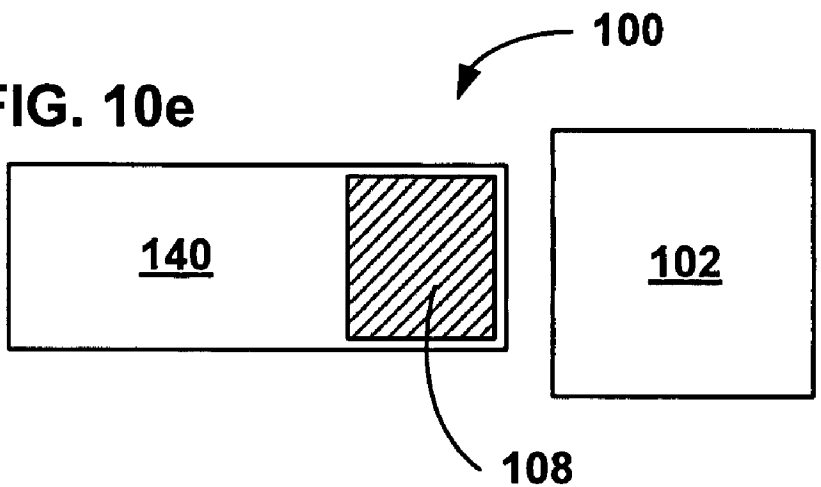

FIGS. 10*a* through 10*e* illustrate an example of how a label may be applied to a substrate. The label 100 may include a face stock 104 and a laminate material 108 mounted on a liner 102. As illustrated in FIG. 10*a*, a first portion 102*a* of the liner may be removed from the label 100 to expose an adhesive on the bottom surface 103 of the face stock 104. At least a portion of the face stock 104 may be adhered to a substrate surface 140 as illustrated in FIG. 10*b*. The liner 102 may then be folded at creases 112 and 114, as illustrated in FIG. 10*c* to allow the bottom surface 107 (see FIG. 2) of the laminate 108 to be positioned or located over the top surface 105 of the face stock 104, as illustrated in FIG. 10*d*. Once the laminate material 108 has been positioned over the face stock 104, at least a portion of the laminate 108 may be adhered to the face stock 104 and the remainder of the liner 102 may be removed from both the laminate 108 and face stock 104 as illustrated in FIG. 10*e*. The remainder of the laminate 108 and/or face stock 104 may then be adhered to the substrate surface 140.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A label comprising:

a liner including a first liner portion and a second liner portion;

a face stock having a first face stock surface and a second face stock surface opposite said first face stock surface disposed over at least a portion of said first liner portion and at least a portion of said second liner portion, wherein said second face stock surface is proximate to said liner;

a laminating material having a first laminating material surface and a second laminating material surface opposite said first laminating material surface and a first edge and a second edge, wherein said laminating material is disposed over at least a portion of said second liner portion and said second laminating material surface is proximate to said liner; and said second liner portion includes at least two creases, wherein one crease of said at least two creases is positioned between said first and second edges of said laminating material and said liner is capable of folding at said one crease positioned between said first and second edges of said laminating material to locate said second laminating material surface of said laminating material over said first face stock surface.

2. The label of claim 1, further comprising a first adhesive positioned between at least a portion of said liner and said face stock.

3. The label of claim 1, further comprising a second adhesive positioned between at least a portion of said liner and said laminating material, wherein said second adhesive contacts at least a portion of said first face stock surface when said laminating material is located over said first face stock surface.

4. The label of claim 2, wherein said first adhesive has a service temperature in the range of −240° C. to 205° C.

5. The label of claim 1, wherein said laminating material exhibits a first surface area $SA_1$ and said face stock exhibits a second surface area $SA_2$, and $SA_1 > SA_2$.

6. The label of claim 1, further comprising a slit in said liner.

7. The label of claim 1, further comprising a perforation in said liner positioned between at least two pieces of face stock.

8. The label of claim 1, wherein said face stock includes perforations.

9. The label of claim 1, wherein said laminating material includes an opaque coating on at least a portion of said first laminating material surface.

10. The label of claim 9, wherein said opaque coating is removable.

11. A method of forming a label including a laminating layer comprising:

providing a liner including a first liner portion and a second liner portion;

disposing a face stock over a portion of said first liner portion and said second liner portion, wherein said face stock has a first face stock surface and a second face stock surface, and said second face stock surface is proximate to said liner;

disposing a laminating material over a portion of said second liner portion, wherein said laminating material has a first laminating material surface and a second laminating material surface and a first edge and a second edge, and said second laminating material surface is proximate to said liner; and providing at least two creases in said second liner portion, wherein one crease of said at least two creases is positioned between said first and second edges of said laminating material and wherein said second liner portion is capable of folding at said one crease to locate said second laminating material surface of said laminating material over said first face stock surface.

12. The method of claim 11, further comprising disposing an adhesive between said liner and said face stock.

13. The method of claim 11, further comprising disposing a second adhesive between said liner and said laminating material, wherein said second adhesive contacts said first face stock surface when said laminating material is located over said face stock.

14. The method of claim 11, further comprising providing a slit in said liner.

15. The method of claim 11, further comprising providing a perforation in said liner positioned between two or more pieces of face stock.

16. The method of claim 11, further comprising providing an opaque coating on at least a portion of said first laminating material surface.

17. A method of laminating labels comprising:

providing a label comprising:

a liner including a first liner portion and a second liner portion, a face stock having a first face stock surface and a second face stock surface opposite said first face stock surface disposed over at least a portion of said first liner portion and said second liner portion, wherein said second face stock surface is proximate to said liner, a laminating material having a first laminating material surface and a second laminating material surface opposite said first laminating material surface and a first edge and a second edge, wherein said laminating material is disposed over at least a portion of said second liner portion, and said second laminating material surface is proximate to said liner, and said second liner portion including at least two creases wherein one crease of said at least two creases is positioned between said first and second edges of said laminating material; and folding said second liner portion at said creases to locate said second laminating material surface of said laminating material over said first face stock surface of said face stock.

18. The method of claim 17, wherein said label includes a first adhesive disposed between at least a portion of said liner and said face stock.

19. The method of claim 17, wherein said label includes a second adhesive disposed between at least a portion of said liner and said laminating material.

20. The method of claim 17, further comprising printing graphics on said face stock.

* * * * *